US008104291B2

(12) United States Patent
Myers et al.

(10) Patent No.: US 8,104,291 B2
(45) Date of Patent: Jan. 31, 2012

(54) COMBUSTION CAP FLOATING COLLAR USING E-SEAL

(75) Inventors: Geoffrey David Myers, Simpsonville, SC (US); Xiaoguang Yu, Greer, SC (US)

(73) Assignee: General Electric Company, Schenectady, NY (US)

( * ) Notice: Subject to any disclaimer, the term of this patent is extended or adjusted under 35 U.S.C. 154(b) by 979 days.

(21) Appl. No.: 12/078,101

(22) Filed: Mar. 27, 2008

(65) Prior Publication Data

US 2009/0243230 A1 Oct. 1, 2009

(51) Int. Cl.
*F02C 7/20* (2006.01)

(52) U.S. Cl. ..... 60/800; 60/799

(58) Field of Classification Search ..... 60/804, 60/752, 39.37, 746, 747, 737, 748, 800, 796; 277/630, 637, 644, 647
See application file for complete search history.

(56) References Cited

U.S. PATENT DOCUMENTS 5,987,879 A * 11/1999 Ono ..... 60/800
6,652,231 B2 * 11/2003 Vedantam et al. ..... 415/214.1
6,910,336 B2 * 6/2005 Sullivan et al. ..... 60/798

* cited by examiner

*Primary Examiner* — William H Rodriguez
*Assistant Examiner* — Craig Kim
(74) *Attorney, Agent, or Firm* — Nixon & Vanderhye, PC

(57) ABSTRACT

An improved floating collar assembly for gas turbine combustion units consists of a sheet metal collar with a flat flange and an E seal that is pre-compressed within a block of epoxy. The collar fits over a corresponding fuel nozzle burner tube and is retained on a cap assembly by a flat plate. During assembly, the collar is loose so that it floats, which makes cap assembly easy. During operation, the epoxy used to pre-compress the E seal heats up and burns off, whereupon the E seal opens up and produces a seating load between the collar and plate that is high enough to keep the collar from rotating and thereby reduce collar wear.

20 Claims, 8 Drawing Sheets

COMBUSTION CAP FLOATING COLLAR USING E-SEAL

The present invention relates to gas turbines, and, more particularly, to a combustion cap floating collar for gas turbine combustion units.

BACKGROUND OF THE INVENTION

A gas turbine combustion system typically consists of several combustion chambers and, inside each chamber, there are several fuel nozzle assemblies. Positioned over the fuel nozzles is a cap assembly equipped with matching number of floating collars which are held inside corresponding counter bores by a retaining plate. When installed, these floating collars fit over the outside surface of fuel nozzle burner tubes and function as air leak limiters. Most cap floating collars experience severe wearing during combustion operation and have to be replaced, resulting in operating cost and reliability being significant issues. Analysis of the worn collars has shown that collar rotation during the operation is the cause of the collars failure. As the floating collars rotate, there is frictional wearing between the collars and a backing plate.

BRIEF DESCRIPTION OF THE INVENTION

The present invention is an improved cap floating collar assembly for gas turbine combustion units that reduces floating collar wear, to thereby improve floating collar reliability. The floating collar assembly fits over a corresponding fuel nozzle burner tube and is retained by a flat plate in a counterbore on the cap assembly. The collar assembly consists of two parts, i.e., a sheet metal collar with a flat flange and an E seal that is pre-compressed within a block of epoxy. During assembly, the collar is loose so that it floats, which makes cap assembly easy. This feature is also a very important requirement for field service. When the gas turbine starts to run, the epoxy used to pre-compress the E seal heats up and burns off, whereupon the E seal opens up and produces a seating load between the collar and plate that is high enough to keep the collar from spinning, to thereby reduce collar wear.

DETAILED DESCRIPTION OF THE INVENTION

Figure 1:
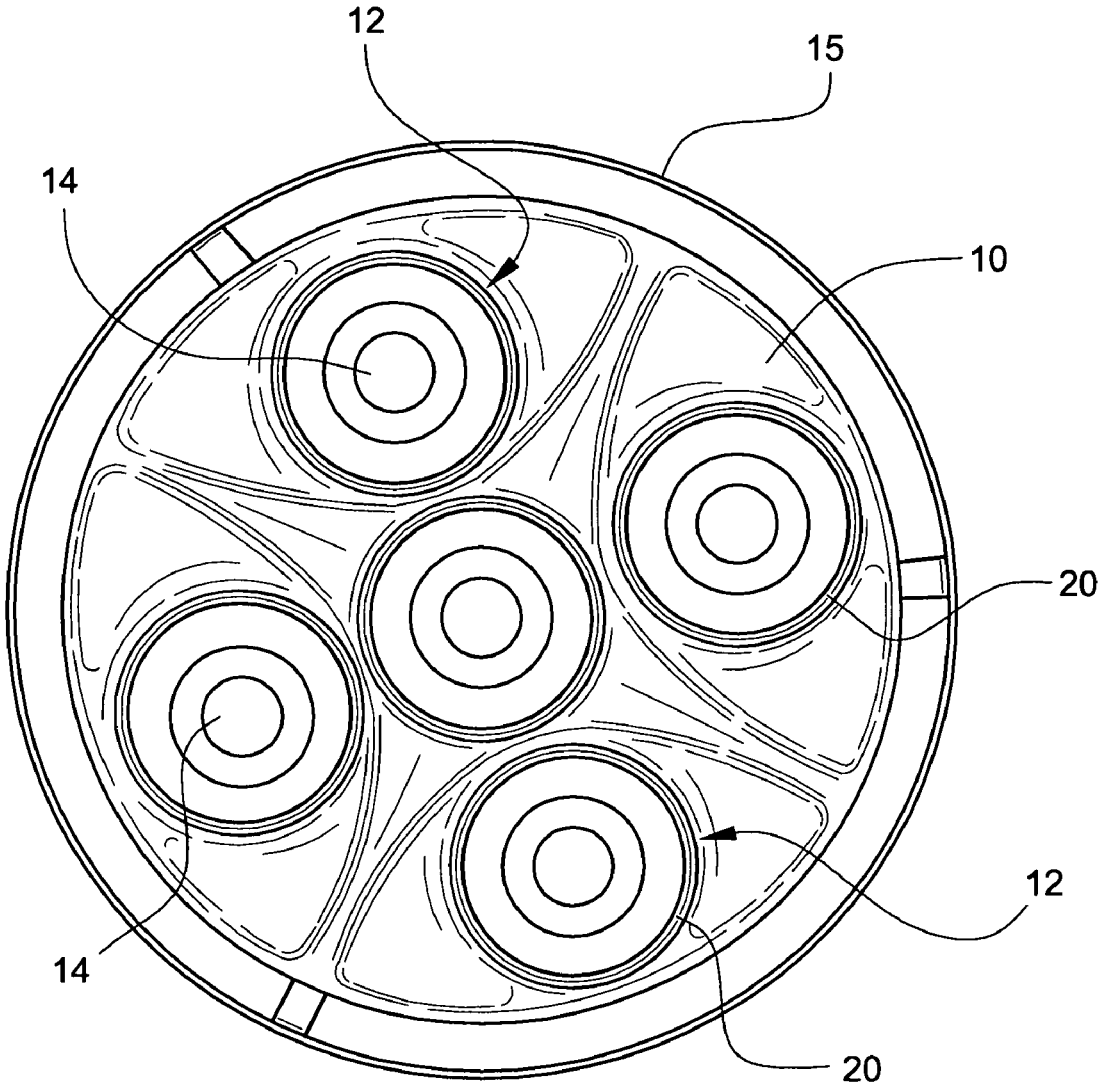
FIG. 1 is a plan view of a cap assembly covering several fuel nozzle assemblies.

FIG. 1 shows a top plan view of a combustion cap assembly 10 for a gas turbine with five fuel nozzle assemblies 12 within five corresponding counter bores 20 in cap assembly 10. Cap assembly 10 is mounted within combustor 15.

Figure 2:
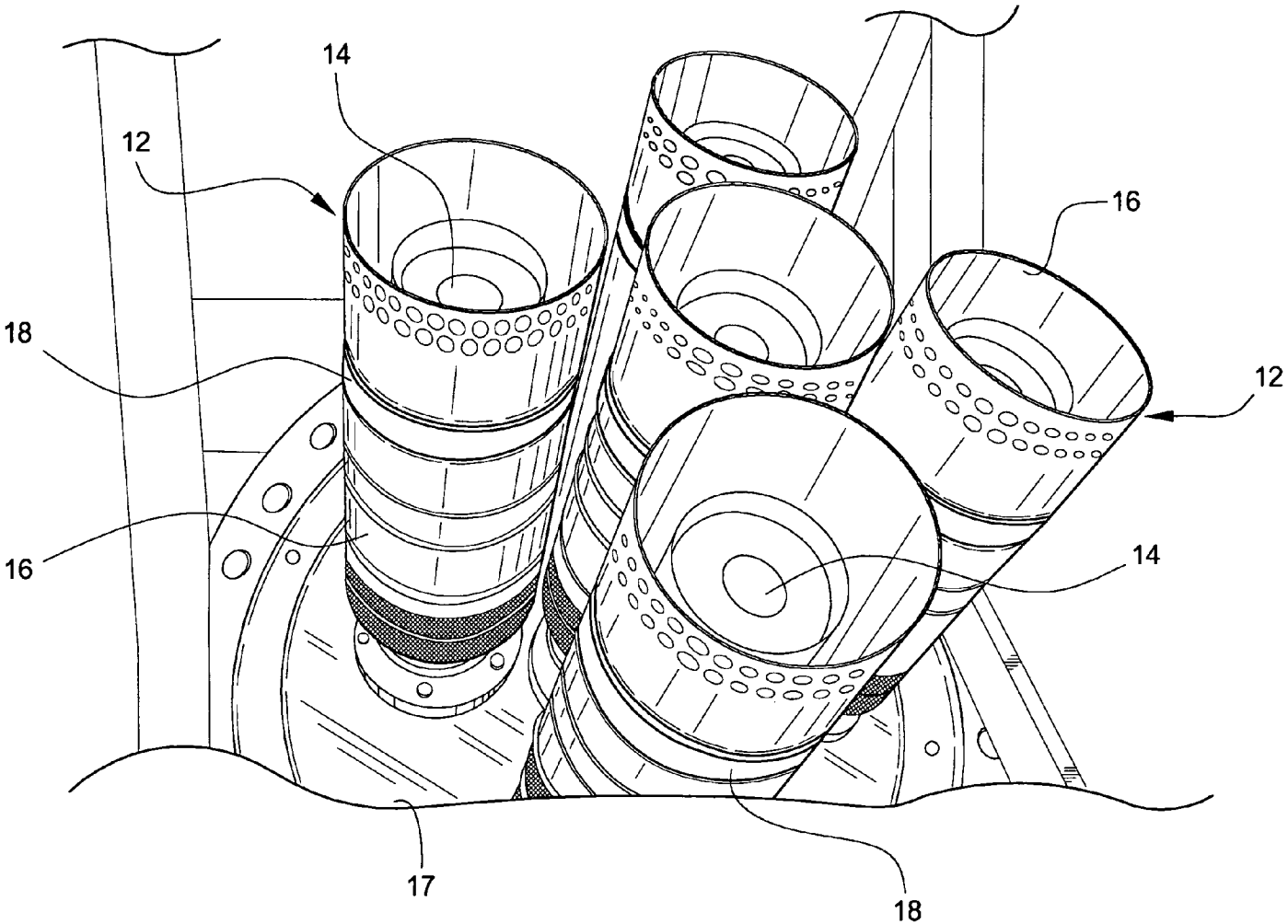
FIG. 2 is a top perspective view of the fuel nozzle assemblies shown in FIG. 1 without the cap covering them and being mounted on an end cover.

FIG. 2 is a top perspective view of the five fuel nozzle assemblies 12 from FIG. 1 shown being bolted to an end cover 17. Each of the fuel assemblies 12 includes a burner assembly 14 that is located within a corresponding fuel nozzle tube 16. Each fuel nozzle tube 16 includes a shoulder 18 corresponding to a change in the outside diameter of the fuel nozzle tube. As described in greater detail below, the shoulder 18 of fuel nozzle tube 16 engages a floating collar 22 that is part of the floating collar assembly of the present invention.

Figure 3:
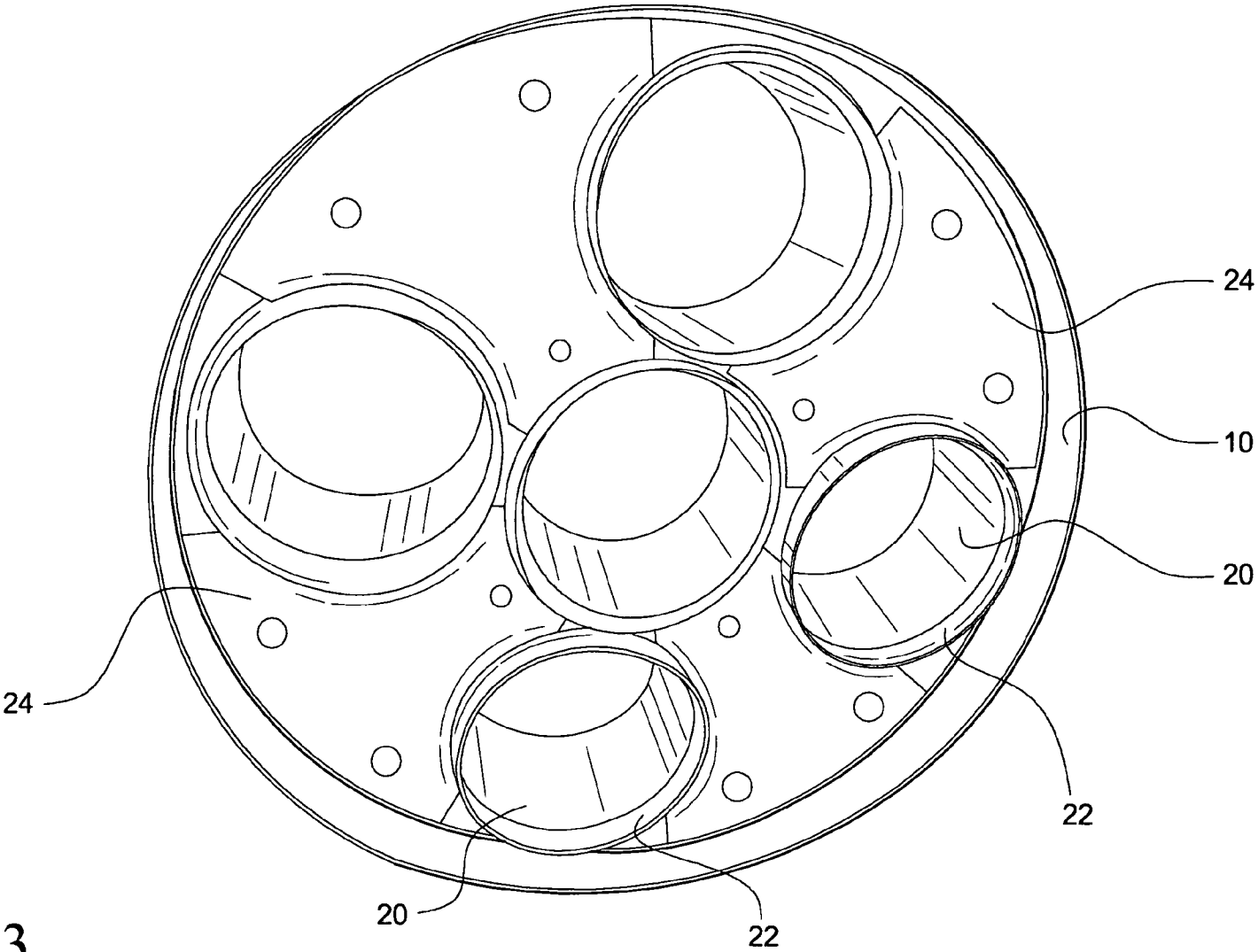
FIG. 3 is a bottom perspective view of the inside of the cap assembly showing several counter bores in which the fuel nozzle assemblies are inserted and corresponding floating collars that are held in the counter bores by retaining plates.

FIG. 3 is a bottom perspective view of the cap assembly 10 shown in FIG. 1. Cap assembly 10 includes the five counter bores 20 shown in FIG. 1. Within the counter bores 20 are five corresponding floating collars 22 that are held in place by four retaining plates 24 attached to the bottom side of cap assembly 10. The manner in which the floating collars are held by plates 24 is described in greater detail below with respect to FIG. 6.

Figure 4A:
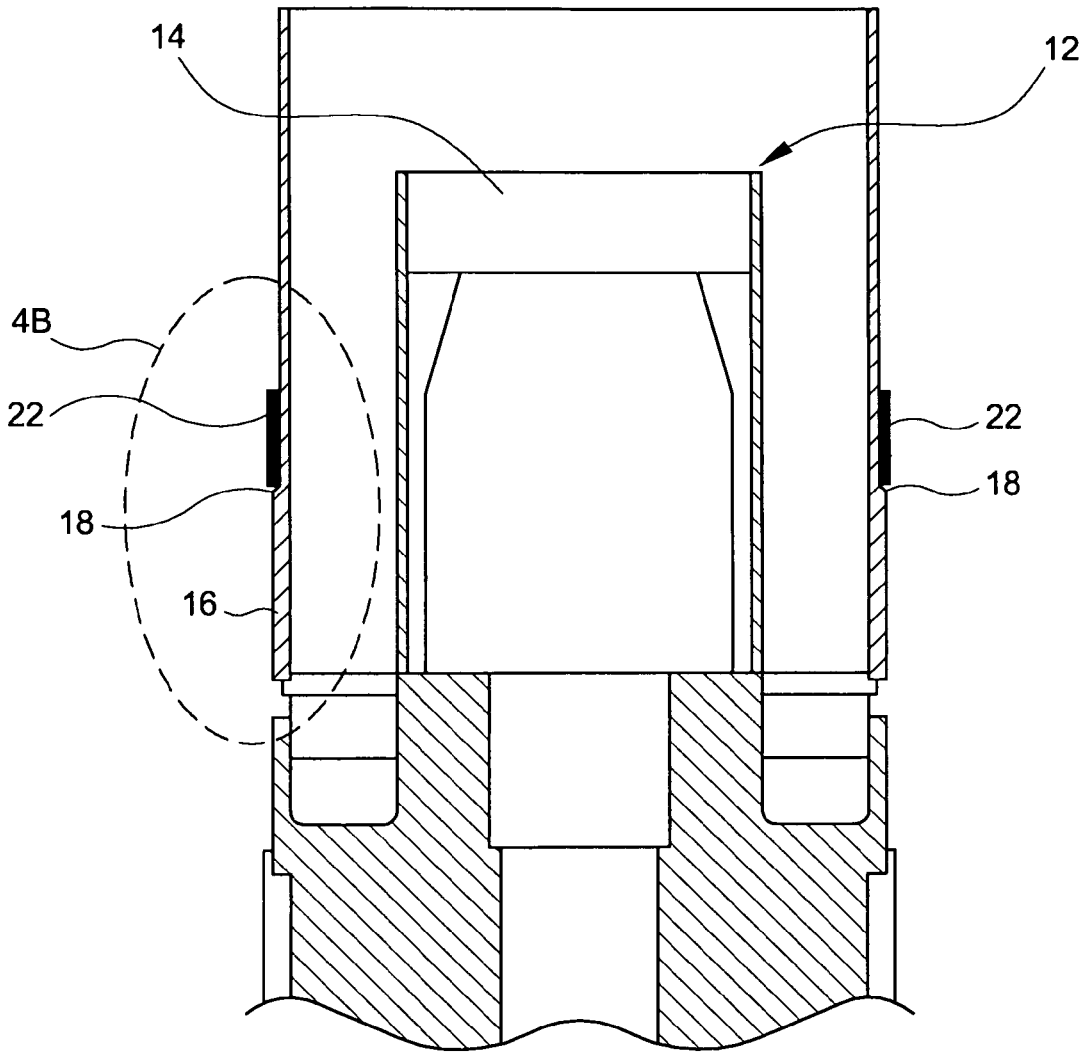
FIG. 4A is a simplified side elevational and partial cross-sectional view of a fuel assembly.

FIG. 4A is a simplified and partial side cross-sectional view of a fuel burner assembly 12, the majority of the details of which are not relevant to an explanation of the floating collar assembly of the present invention. FIG. 4A shows a fuel nozzle tube 16 and a fuel burner 14 located within tube 16 in cross section and a floating collar 22, also in cross section, positioned over the exterior of fuel burner tube 16.

Figure 4B:
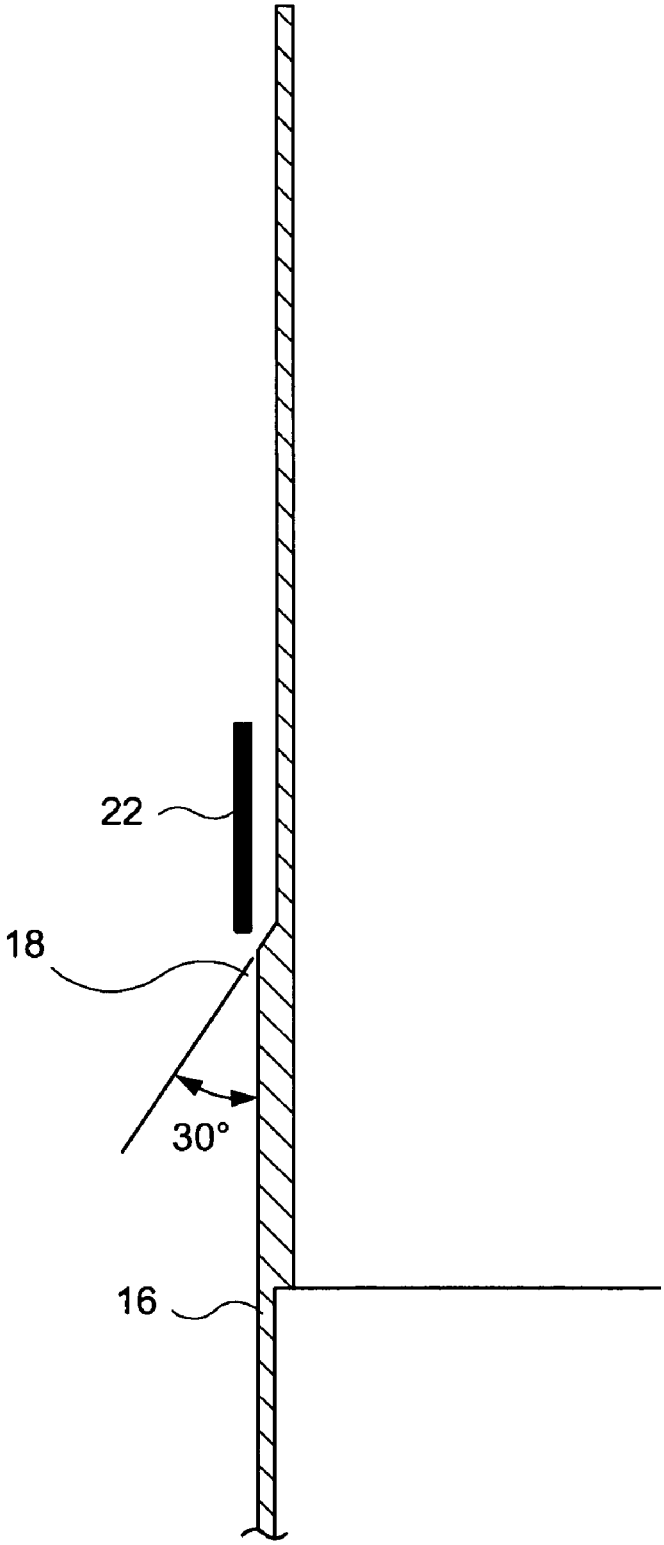
FIG. 4B is a partial side elevational, cross-sectional view of a portion of the fuel assembly shown in FIG. 4A.

FIG. 4B is an enlarged cross-sectional view of a portion of the fuel nozzle tube 16 and the floating collar 22 shown in FIG. 4A to better show the manner in which the floating collar engages the fuel burner tube 16 when it is position over the exterior of fuel burner tube 16. As can be seen in FIG. 4B, the fuel burner tube 16 includes a shoulder 18 that constitutes a change in the outside diameter of fuel burner tube 16. Floating collar 12 engages shoulder 18 of fuel burner tube 16 when counter bore 20 in cap assembly 10 is positioned over tube 16 as cap assembly is attached to a fuel burner assembly.

Figure 5A:
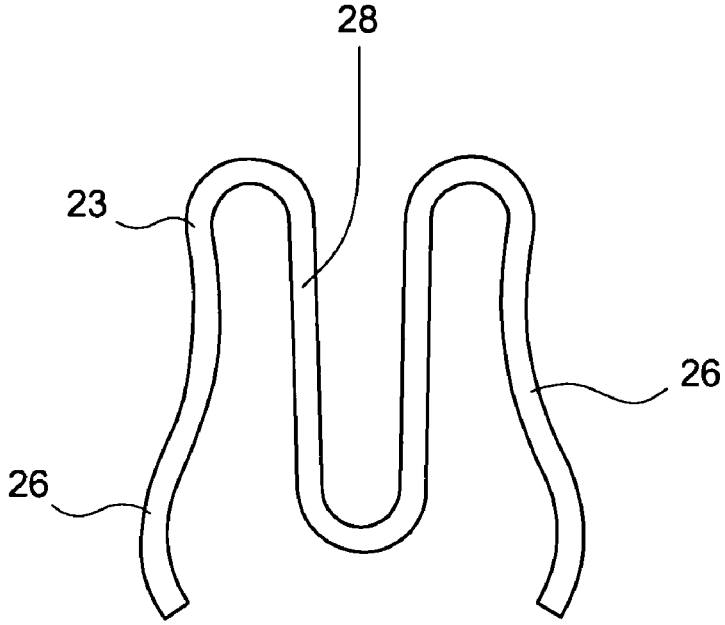
FIG. 5A is a side elevational, cross-sectional view of an E seal used as part of the collar assembly of the present invention.
Figure 5B:
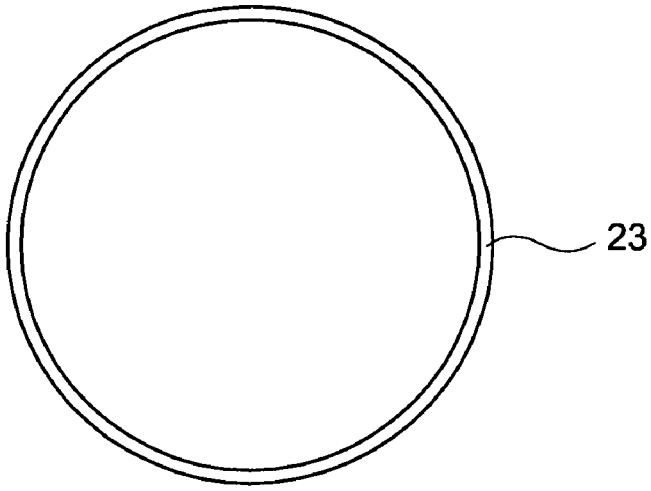
FIG. 5B is a top plan view of the E seal of FIG. 5A.

FIGS. 5A and 5B are a side, cross-sectional view and a top plan view, respectively, of a sealing spring 23 used to hold the floating collar 22 in place during burner operation. As can be seen in FIG. 5A, preferably, sealing spring 23 has a shape, in cross-section, that is similar the capital letter "E", although it should be noted that sealing springs with other shapes could be used in the present invention. As can be seen in FIG. 5B, preferably, sealing spring 23 5 has a plan view shape that is substantially circular so as to allow sealing spring 23 to also be positioned over the exterior of fuel burner tube 16.

In its E shape preferred embodiment, sealing spring 23 has a center section 28 shaped like a hairpin and two curved ends 26 that connect at one end to center section 28 to complete the cross-sectional "E" shape of sealing spring 23. As can also be seen from FIG. 5A, the preferred "E" shape of sealing spring 23 results in a spring configuration that can be compressed to produce a force acting counter to the compression of sealing spring 23. Here again, it should be noted that sealing springs with other compressible shapes that produce a similar counter-acting force could be used in the present invention.

Figure 6:
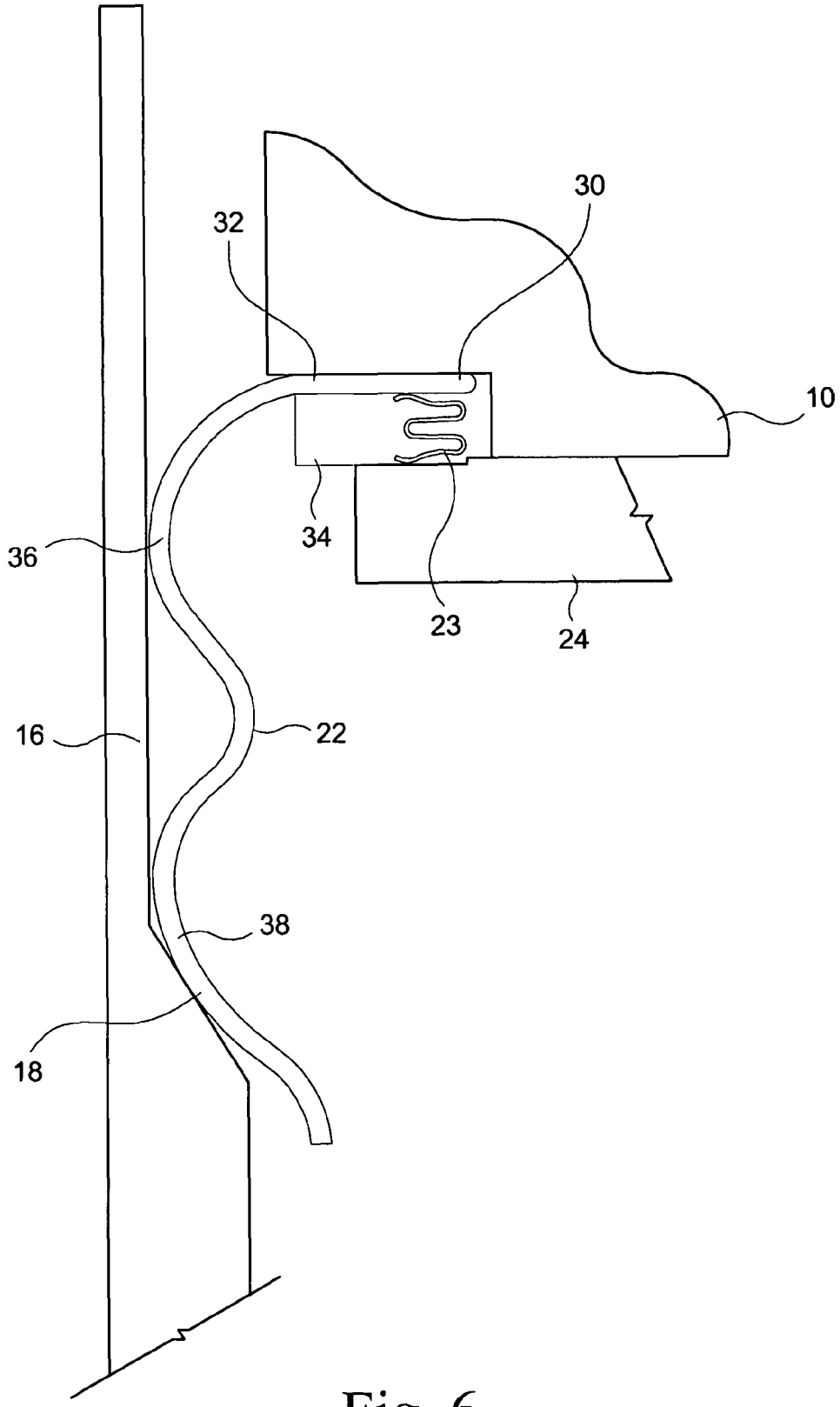
FIG. 6 is a partial side elevational, cross-sectional view of the floating collar and E seal of the present invention mounted in a cap assembly and engaging a fuel nozzle tube.

FIG. 6 shows the cap floating collar design of the present invention when it is initially installed in the cap assembly of a gas turbine. As shown in FIG. 6, the cap assembly 10 includes a shoulder 32, which is engaged by a flat flange 30 of floating collar 22. Positioned over flat flange 30, between cap 10 and retaining plate 24, is sealing spring 23. As can be seen in FIG. 6, sealing spring 23 is initially encased in a block of epoxy 34. As can also be seen from FIG. 6, the floating collar 22 has a "curvy" shape to it, such that as it extends from flat flange 30, it curves inwardly and outwardly towards and away from the side wall of fuel burner tube 16 so that a first curve 36 of collar 22 engages tube 16 at a first location and a second curve 38 of collar 22 engages tube 16 at tube shoulder 18.

Figure 7:
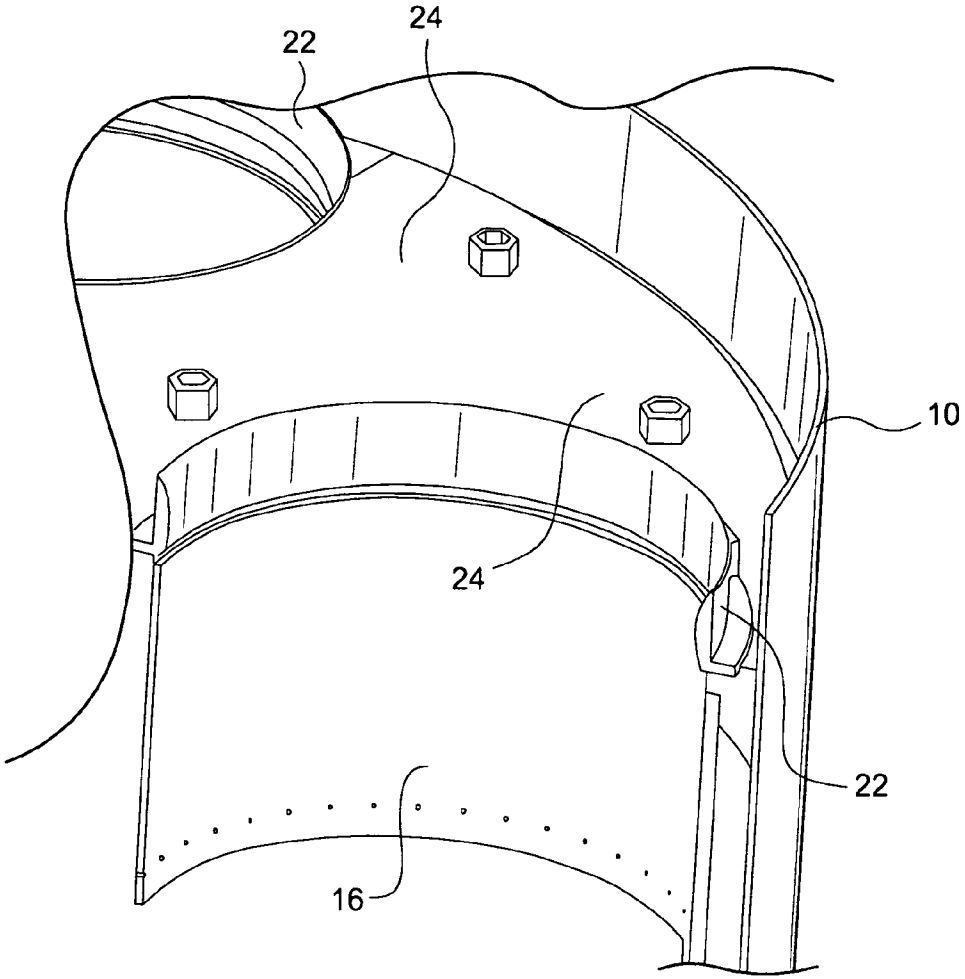
FIG. 7 is a schematic, bottom perspective view of the floating collar of the present invention engaging a fuel nozzle tube and being held inside of the cap assembly by a retaining plate.

FIG. 7 is a perspective, schematic view of the floating collar 22 of the present invention installed on the cap assembly 10 and surrounding a fuel nozzle tube 16. Here again, it can be seen that the floating collar 22 is held in place with respect to the cap assembly 10 by the retaining plate 24, such that when the fuel nozzle tubes 16 that are part of the fuel nozzle assembly 12 are inserted into the cap assembly 11, the floating collar 12 engages the outside wall of the fuel nozzle tube 16.

During operation of the gas turbine, the epoxy block 34 initially encasing sealing spring 23 heats up and burns off, whereupon sealing spring 23 is able to open up and produce a seating load high enough to keep the floating collar 22 from spinning around fuel nozzle tube 16 during operation of the gas turbine. The load is exerted between the cap assembly 10 at the shoulder 32 and the retaining plate 24 engaging the bottom side of sealing spring 23.

Thus, in the present invention, for a typical cap assembly there are five floating collars 22 that are held inside of cap assembly 10 by corresponding retaining plates 24. Once the cap assembly 10 is installed over the fuel nozzle assemblies 12, which include the fuel nozzles 14 mounted on the end cover 17, the fuel nozzles 14 fit through the counter bores 20 in the cap assembly 10. Upon final assembly, the floating collars 22 rest or sit on an outside surface of the nozzle tubes 16, and ultimately are held in place by the expansion of corresponding sealing spring 23 that produce the seating loads upon the heating up and burning off of the epoxy blocks 34 that are used to initially compress sealing spring 23. Expansion of sealing springs 23 and the resulting seating loads prevents the floating collars 22 from rotating during burner operation. This, in turn, reduces the wear of the floating collars to thereby improve their reliability.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. At least one floating collar assembly for a cap of a combustion unit containing at least one fuel nozzle assembly corresponding to the at least one floating collar assembly, each of the at least one fuel nozzle assemblies including a fuel nozzle burner tube, each of the at least one floating collar assemblies comprising:

a floating collar positioned around a side wall of a corresponding fuel nozzle burner tube, the collar including a flange for engaging the cap, the flange being substantially parallel to the side wall of the burner tube when the floating collar is positioned around the side wall, and a sealing spring positioned between the flange and a plate attached to the cap, the plate being substantially parallel to the side wall of the burner tube when the cap and plate are positioned over the burner tube, the sealing spring producing a seating load between the collar flange and the plate to hold the flange against the cap and thereby prevent the floating collar from rotating during combustion unit operation.

2. The floating collar assembly of claim 1, wherein the collar is substantially circular and positioned over an exterior of the fuel nozzle burner tube so as to engage a shoulder in the tube exterior when the cap is attached to the combustion unit.

3. The floating collar assembly of claim 2, wherein the sealing spring is substantially circular and extends around the exterior of the fuel nozzle burner tube when the cap is attached to the combustion unit.

4. A floating collar assembly for a combustion unit cap, the floating collar assembly comprising:

a collar including a flange for engaging the cap, and a sealing spring positioned between the flange and a plate attached to the cap, the sealing spring producing a seating load between the collar flange and the plate to hold the flange against the cap and thereby prevent the collar from rotating during combustion unit operation, wherein the collar is substantially circular and positioned over an exterior of a fuel nozzle burner tube so as to engage a shoulder in the tube exterior when the cap is attached to the combustion unit, and wherein the collar has a first curve that engages the tube exterior at a first location and a second curve that engages the tube exterior at the tube shoulder.

5. The floating collar assembly of claim 1, wherein, during assembly of the cap to the combustion unit, the collar is loose.

6. The floating collar assembly of claim 5, wherein, during assembly of the cap to the combustion unit, the sealing spring is held in a compressed position by epoxy.

7. The floating collar assembly of claim 6, wherein, during combustion unit operation, the epoxy heats up and burns off, whereupon the sealing spring is decompressed and produces a seating load between the collar flange and plate so as to keep the collar from spinning during combustion unit operation to thereby reduce collar wear.

8. The floating collar assembly of claim 1, wherein the sealing spring has a shape, in cross-section, that is similar the capital letter "E".

9. The floating collar assembly of claim 8, wherein the sealing spring has a center section shaped like a hairpin and two curved ends that connect at one end to center section to complete the cross-sectional "E" shape of the sealing spring.

10. The floating collar assembly of claim 1, wherein the cap includes a shoulder, which is engaged by the flange of the floating collar.

11. At least one floating collar assembly for a cap of a combustion unit containing at least one fuel nozzle assembly corresponding to the at least one floating collar assembly, each of the at least one fuel nozzle assemblies including a corresponding fuel nozzle burner tube, each of the at least one floating collar assemblies comprising:

a substantially circular floating collar positioned around a side wall of a corresponding fuel nozzle burner tube, the collar including a flat flange for engaging the cap, the flange being substantially parallel to the side wall of the burner tube when the floating collar is positioned around the side wall, and a substantially circular, compressible sealing spring positioned between the flat flange and a flat plate attached to a back side of the cap, the plate being more perpendicular than parallel to the side wall of the burner tube when the cap and plate are positioned over the burner tube, the sealing spring producing a seating load between the collar flange and the flat plate to thereby hold the flange against the cap and prevent the floating collar from rotating during combustion unit operation.

12. The floating collar assembly of claim 11, wherein the collar is positioned over an exterior of the fuel nozzle burner tube so as to engage a shoulder in the tube exterior and the sealing spring extends around the exterior of the fuel nozzle burner tube when the cap is attached to the combustion unit.

13. A floating collar assembly for a combustion unit cap, the floating collar assembly comprising:

a substantially circular collar including a flat flange for engaging the cap, and a substantially circular, compressible sealing spring positioned between the flat flange and a flat plate attached to a back side of the cap, the sealing spring producing a seating load between the collar flange and the flat plate to thereby hold the flange against the cap and prevent the collar from rotating during combustion unit operation, wherein the collar is positioned over an exterior of a fuel nozzle burner tube so as to engage a shoulder in the tube exterior and the sealing spring extends around the exterior of the fuel nozzle burner tube when the cap is attached to the combustion unit, and wherein the collar has a curvy shape, such that as it extends from the flat flange, it curves towards and away from the exterior of the fuel nozzle burner tube, whereby a first curve of the collar engages the tube exterior at a first location and a second curve of the collar engages the tube exterior at the tube shoulder.

14. The floating collar assembly of claim 11, wherein, during cap assembly, the collar is loose so that it floats and the sealing spring is pre-compressed within a block of epoxy.

15. The floating collar assembly of claim 14, wherein the epoxy heats up and burns off during operation of the combustion unit, whereupon the sealing spring is decompressed and engages the flat flange and flat plate to produce the seating load between the collar and plate that keeps the collar from spinning during combustion unit operation to thereby reduce collar wear.

16. The floating collar assembly of claim 11, wherein the sealing spring has a shape, in cross-section, that is similar the capital letter "E".

17. The floating collar assembly of claim 16, wherein the sealing spring has a center section shaped like a hairpin and two curved ends that connect at one end to center section to complete the cross-sectional "E" shape of the sealing spring.

18. The floating collar assembly of claim 1, wherein the cap includes a shoulder, which is engaged by the flat flange of the floating collar.

19. A method of securing at least one floating collar within a combustion unit cap to keep the collar from spinning during combustion unit operation to thereby reduce collar wear, the combustion unit containing at least one fuel nozzle assembly corresponding to the at least one floating collar, each of the at least one fuel nozzle assemblies including a corresponding fuel nozzle tube, the method comprising the steps of:

providing a circular floating collar around an exterior side wall of a corresponding fuel nozzle burner tube, the collar including a flat flange that is substantially parallel to the side wall of the burner tube when the collar is positioned around the side wall, positioning the collar adjacent to a circular a shoulder formed in the cap, positioning an "E" shaped sealing spring that is pre-compressed in epoxy adjacent to the collar's flat flange, attaching a plate to the cap so as to position the "E" shaped sealing spring between the flat flange and the plate and thereby allow the collar to float between the plate and the shoulder formed in the cap, and attaching the cap to the combustion unit, whereby the collar is positioned over the exterior side wall of the fuel nozzle burner tube so as to engage a shoulder in the tube exterior, the plate being substantially parallel to the exterior side wall of the burner tube when the cap and plate are positioned over the combustion unit.

20. The method of claim 19 further comprising the step of operating the combustion unit so that the epoxy heats up and burns off, whereupon the "E" shaped sealing spring decompresses and engages the flange and plate to produce a seating load between the collar flange and plate that keeps the collar from spinning during combustion unit operation to thereby reduce collar wear.

* * * * *